US007374151B2

(12) United States Patent
Birdsall et al.

(10) Patent No.: US 7,374,151 B2
(45) Date of Patent: May 20, 2008

(54) WINCH CABLE REWIND GUIDE

(76) Inventors: Thomas J. Birdsall, P.O. Box 790, Galliano, LA (US) 70354; Timothy J. James, 4705 Sonfield, Metairie, LA (US) 70006

( * ) Notice: Subject to any disclaimer, the term of this patent is extended or adjusted under 35 U.S.C. 154(b) by 104 days.

(21) Appl. No.: 11/080,468

(22) Filed: Mar. 16, 2005

(65) Prior Publication Data

US 2006/0231814 A1 Oct. 19, 2006

(51) Int. Cl.
*B65H 59/00* (2006.01)
*B65H 59/16* (2006.01)
*D06F 53/00* (2006.01)

(52) U.S. Cl. ..... 254/134.3 R; 24/134 R; 188/65.1

(58) Field of Classification Search ..... 254/134.3 R, 254/134.3 FT; 294/1.1, 104; 403/342, 369; 24/134 R, 132 R; 188/65.1
See application file for complete search history.

(56) References Cited

U.S. PATENT DOCUMENTS 263,775 A 9/1882 Emmert
294,629 A 3/1884 Jenkins
678,246 A 7/1901 Hansel
2,448,384 A 8/1948 Meinzinger
3,312,128 A 4/1967 Wasson
3,675,898 A * 7/1972 Fattor et al. ..... 254/134.3 FT
3,763,722 A * 10/1973 Ehrens ..... 81/426
4,656,772 A * 4/1987 Lopez ..... 43/4
4,736,978 A * 4/1988 Cielker ..... 294/90
4,787,660 A 11/1988 Mrazek
4,819,911 A 4/1989 Cielker
5,325,746 A * 7/1994 Anderson ..... 81/487
5,806,901 A 9/1998 Tennyson et al.
5,806,902 A * 9/1998 Kliest ..... 294/1.1
6,033,414 A * 3/2000 Tockman et al. ..... 606/129

* cited by examiner

*Primary Examiner*—Evan Langdon
(74) *Attorney, Agent, or Firm*—Jacobson Holman PLLC

(57) ABSTRACT

A handheld guide for guiding a cable being wound onto a powered winch drum includes a split tubular member with opposed longitudinal slots. A pair of cable gripping members are positioned in the split tubular member and each gripping member includes a longitudinally extending actuating member extending outwardly through a slot in the split tubular member. Each of the cable gripping members includes a groove oriented in facing relationship to engage a cable being wound onto the winch drum. The split tubular member and cable gripping members are retained in assembled relation by a pair of slotted end caps threaded onto the ends of the split tubular member.

6 Claims, 3 Drawing Sheets

WINCH CABLE REWIND GUIDE

BACKGROUND OF THE INVENTION

1. Field of the Invention

The present invention relates generally to a winch cable rewind guide and, more specifically, to a rewind guide which is a handheld for guiding a cable being wound onto a powered winch drum.

2. Description of the Related Art

When rewinding untensioned cable, rope, wire or similar flexible strand material onto a winch drum such as one powered by a hydraulic motor, electric motor or manually, the strand being rewound frequently results in convolutions of the coiled strand not being located in a side-by-side contacting relationship. Rather, the spiral convolutions or coils of the strand are frequently spaced apart, cross over each other and wind on top of each other in an uneven pattern. One conventional method of guiding a cable when it is being rewound is to grip the cable with one or both hands to apply tension on the cable and also orient the convolutions of the cable being coiled onto the winch drum in spiral contacting relationship. Work gloves with leather reinforced palms are usually employed to reduce the possibility of injury to the hands of the person guiding the cable.

In addition, various devices have been developed to guide or control rewinding of flexible strands on a spool or drum. For example, levelwind devices have been developed for guiding flexible fishing line onto a reel when rewinding the fishing line. However, such mechanical devices generally have not been successful with rewinding cable on a powered winch drum, such as when mounted on a vehicle or the like, since the angle of approach of the cable to the winch drum is not constant as occurs in a fishing line being guided onto a reel or spool. Frequently, when rewinding a cable onto a powered winch drum, the cable approaches the drum from various angles other than perpendicular to the rotational axis of the winch drum. This requires manual guidance of the cable and application of tension on the cable so that the convolutions of the cable on the drum will snugly engage the drum and also be oriented in an adjacent or contacting spiral relation to each other.

SUMMARY OF THE INVENTION

In order to overcome the drawbacks of the prior art, the present invention is directed to a handheld cable guiding device which includes a split tubular member with opposed longitudinal slots. A pair of cable gripping members are positioned in the split tubular member and each gripping member includes a longitudinally extending actuating handle extending outwardly through one of the slots in the split tubular member. Each of the cable gripping members includes an inwardly facing groove which is oriented in facing relationship to frictionally engage the cable being wound onto the winch drum. The split tubular member and cable gripping members are retained in assembled relation by a pair of slotted end caps threaded onto the ends of the split tubular member.

The winch cable rewind guide of this invention is employed in lieu of conventionally used leather palmed work gloves to guide a cable being rewound onto a powered winch drum such as those found on various vehicles, such as trucks, tractors, ATVs or whenever a powered winch drum is used and it becomes necessary to rewind the cable onto the drum. Use of the present invention reduces the possibility of injury when gripping a cable by a gloved hand and reduces the cost associated with providing a supply of gloves. The guide of this invention also enables the application of greater frictional engagement with the cable than can be provided by a gloved hand. This greater frictional engagement enables more tension to be applied to the cable for more effective and accurate rewinding of the cable with the rewound spiral convolutions being disposed in adjacent or contacting relation when the cable is being rewound on the cable drum.

It is therefore an object of the present invention to provide a winch cable rewind guide in which the relationship of the cable to the winch drum can be controlled as the cable is being rewound and tension can be applied to the cable as it is being rewound to maintain tension on the cable as it is rewound to obtain an optimum coiled arrangement of the cable on the winch drum.

Another object of this invention is to provide a winch cable rewind guide that is handheld and includes a split tubular member with opposed longitudinal slots and a pair of gripping members positioned in the tubular member. Each gripping member includes a longitudinal actuating member extending outwardly through the slots in the tubular member. The gripping members have a groove in their facing surfaces to frictionally engage a cable being wound onto the winch drum. Inward forces applied to the longitudinal actuating members move the gripping members inwardly into frictional contact with the cable not only to be guided onto the drum but also to tension the cable so that convolutions of the cable being wound onto the drum are tightly engaged with the drum and oriented in a tight spiral coil on the drum.

A further object of this invention is to provide a handheld winch cable rewind guide in accordance with the preceding objects in which the split tubular member and gripping members are retained in assembled relation by pair of internally threaded end caps threaded onto the ends of the split tubular member with each end cap having a radial slot to enable the end caps to be laterally positioned over the cable and screw threaded onto the ends of the split tubular member.

A still further object of this invention is to provide a cable rewind guide that can be easily assembled on the cable to be rewound and manually manipulated by utilizing one hand which enables the other hand to assist in guiding the cable into the handheld guide with variations in the tension applied to the cable being obtained by varying the inward force exerted manually on the actuating members which extend outwardly through the slots in the split tubular member.

Yet another object of this invention to be specifically enumerated herein is to provide a handheld winch cable rewind guide in accordance with the preceding objects and which will conform to conventional forms of manufacture, be of simple construction and easy to use so as to provide a rewind guide that will be economically feasible, reliable and long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

The drawings are intended to illustrate the invention, but are not necessarily to scale.

DETAILED DESCRIPTION OF THE PREFERRED EMBODIMENTS

Figure 1:
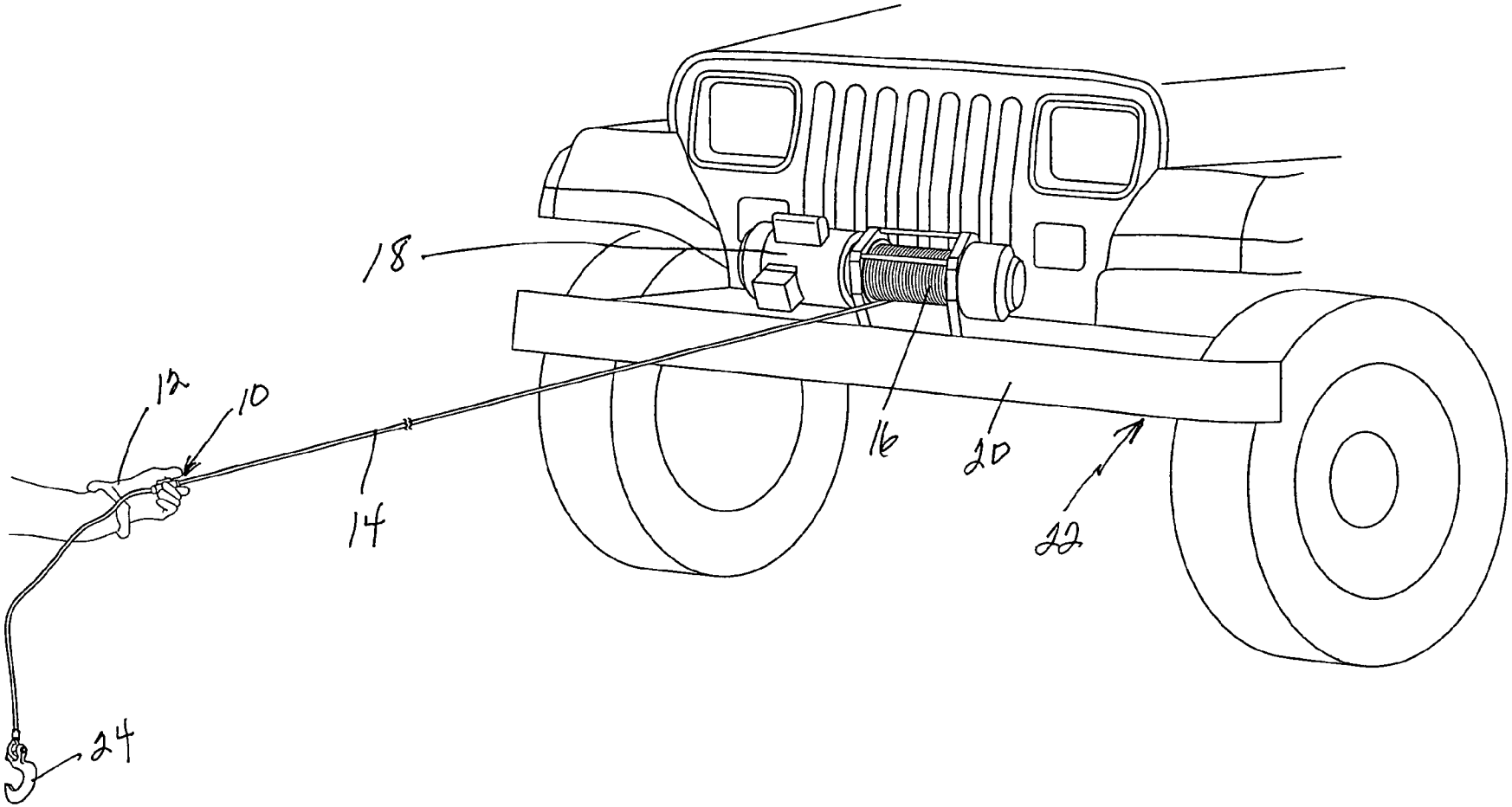
FIG. 1 is a perspective view of the front of a vehicle with a powered winch drum mounted thereon and illustrating a winch cable rewind guide in accordance with the present invention held in one hand for guiding the cable onto the winch drum and exerting tension on the cable as it is being rewound.
Figure 2:
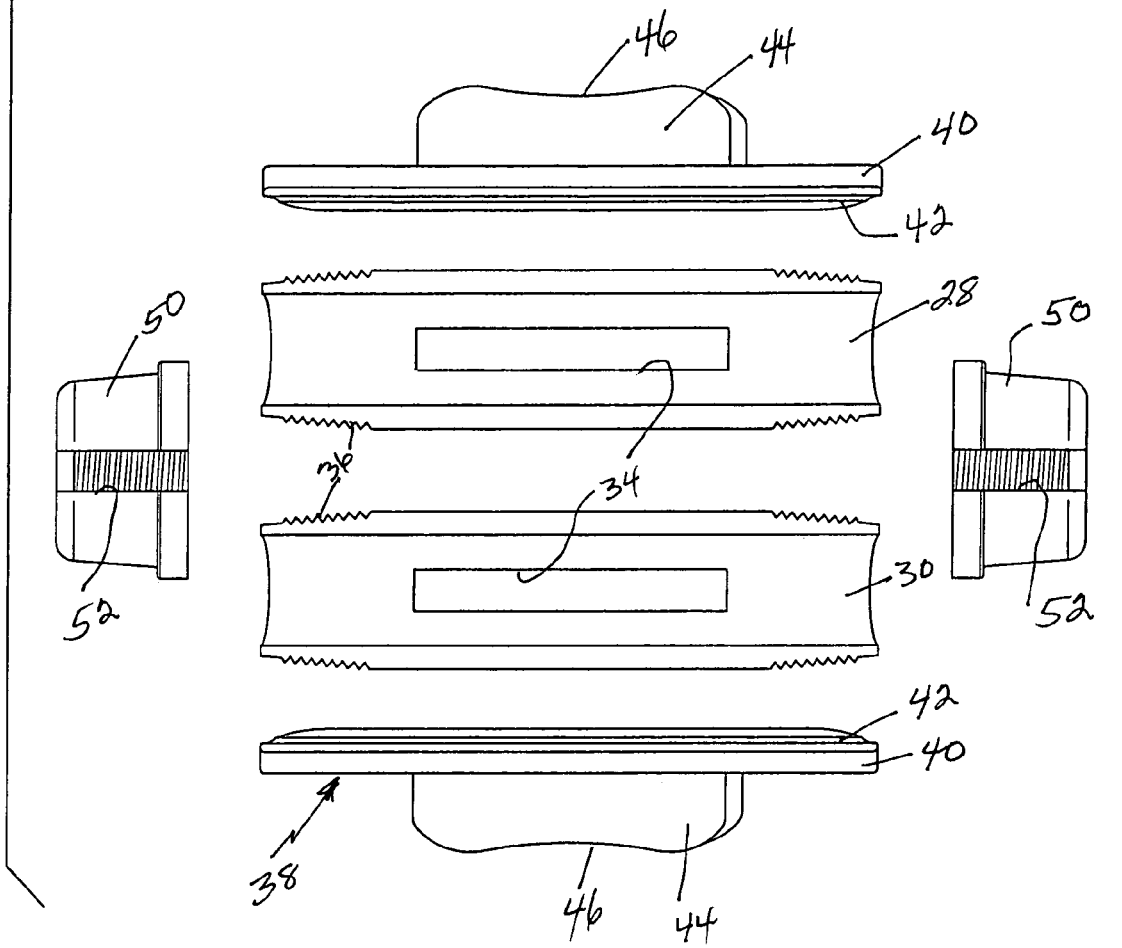
FIG. 2 is an exploded elevational view of the components of the winch cable rewind guide of the present invention illustrating the association of the components before assembly.

Although only one preferred embodiment of the invention is explained in detail, it is to be understood that the invention is not limited in its scope to the details of construction and arrangement of components set forth in the following description or illustrated in the drawings. The invention is capable of other embodiments and of being practiced or carried out in various ways. Also, in describing the preferred embodiment, specific terminology will be resorted to for the sake of clarity. It is to be understood that each specific term includes all technical equivalents which operate in a similar manner to accomplish a similar purpose.

The winch cable rewind guide of the present invention is generally designated by reference numeral 10 and is shown in a typical use in FIG. 1. As shown, the guide 10 is gripped in one hand 12 of a person using the guide when the cable 14 is being rewound on the powered winch drum 16 that is powered by a hydraulic motor, electric motor or the like 18 mounted on the bumper 20, frame or other component of a vehicle 22 such as a truck, tractor, off road vehicle, ATV or the like. Conventionally, the cable 14 includes a hook or other connecting device 24 at the outer free end thereof to connect the cable to a device to be towed or connect the cable to a stationary device to enable the winch drum to be used to move the vehicle 22.

Figure 3:
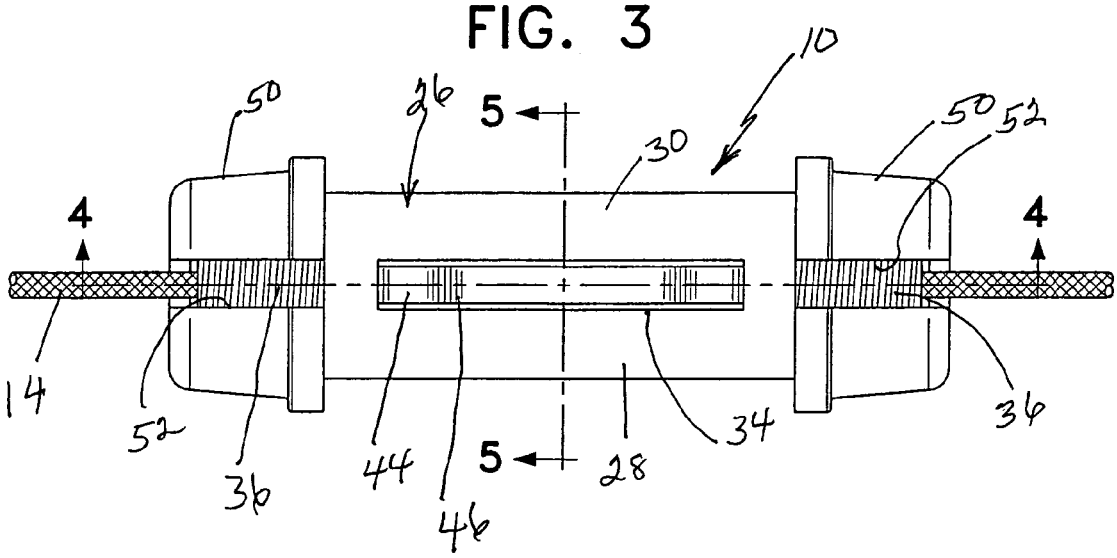
FIG. 3 is an elevational view of the winch cable rewind guide of the present invention illustrating its association with a cable passing through the guide.
Figure 4:
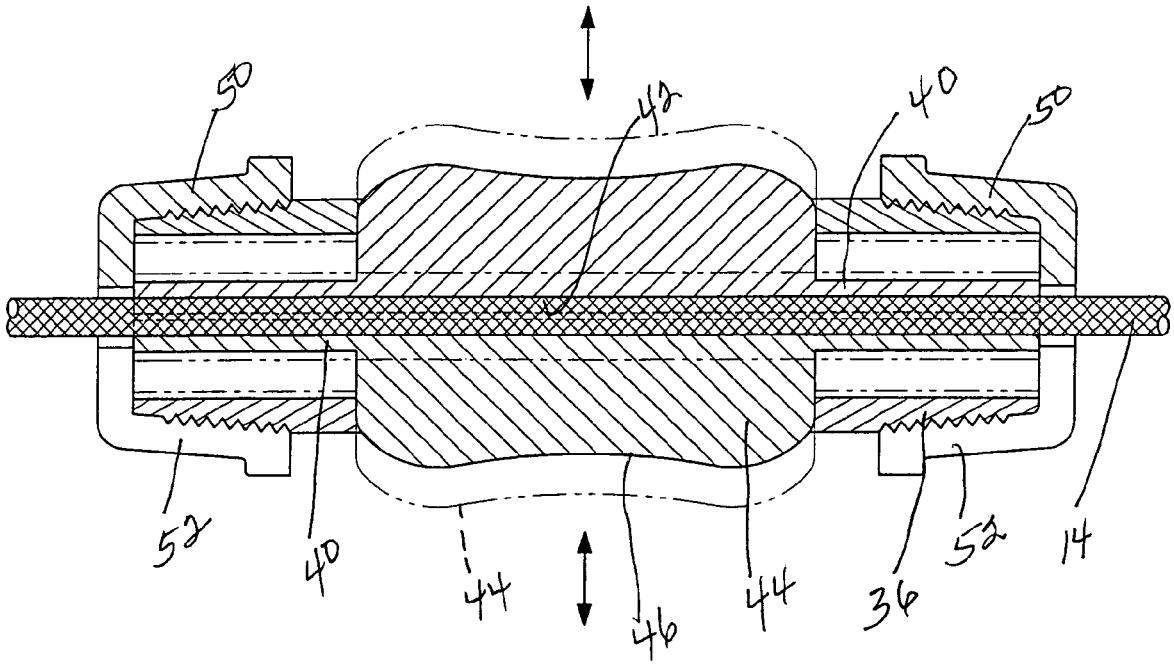
FIG. 4 is a longitudinal sectional view of the winch cable rewind guide taken along section line 4-4 on FIG. 3 illustrating structural details of the guide and its association with the cable.
Figure 5:
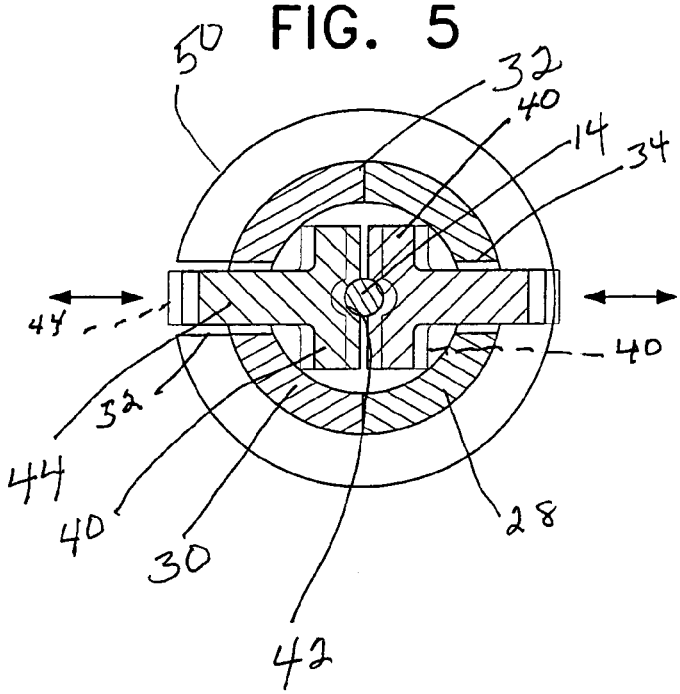
FIG. 5 is a transverse sectional view, on an enlarged scale, taken along section line 5-5 on FIG. 3 illustrating further structural details of the guide and its association with the cable including the grooved gripping members engaging the cable and the actuating members extending outwardly through the slots in the split tubular member.

FIGS. 2-5 illustrate the specific structural details of the guide 10. A substantially rigid tubular member, generally designated by reference numeral 26, is split longitudinally into two half tubes 28 and 30 which have their edges abutting at juncture 32 when the two half tubes 28 and 30 assembled to form the split tubular member 26. FIG. 5 illustrates the half tubes 28 and 30 are assembled into abutting engagement at juncture 32. Each half tube 28 and 30 includes a longitudinal slot 34 oriented centrally between the side edges of the half tubes 28 and 30 which extends over a major length of the half tubes 28 and 30 and terminates inwardly of the ends thereof as illustrated in FIGS. 2-5. Each end of each of the half tubes 28 and 30 has external threads 36 formed thereon so that when the two half tubes 28 and 30 are abutted, the threads 36 will be generally continuous around the split tube 26.

Positioned interiorly of the split tubular member 26 is a pair of oppositely facing cable gripping members of identical construction and generally designated by reference numeral 38. Each of the cable gripping members 38 includes a longitudinally elongated substantially flat plate 40 having a centrally disposed longitudinally extending groove 42 extending throughout the length thereof on one surface of the plate 40. An actuating member 44 extends from the opposite surface of the plate and also extends longitudinally of the plate 40 but less than the full length thereof. The actuating member 44 is in the form of a plate that is moveably received in one of the slots 34 and projects beyond the external surface of the split tubular member 26 as illustrated in FIGS. 4 and 5.

Also as illustrated in FIGS. 4 and 5, the actuating members 44 can be engaged to move the gripping members 38 inwardly to frictionally engage the groove 42 and plate 40 with the external surface of the cable 14 as illustrated in broken lines in FIG. 5. The outer edge of the actuating member 44 is provided with a concave central portion 46 which positions the fingers and thumb of a user's hand 12 on the actuating member 44 thereby enabling inward force to be exerted on each of the actuating members 44 and each of the gripping members 38 to grippingly engage the cable 14. This construction enables the user to exert tension on the cable 14 as the cable is being rewound on the winch drum 16.

In addition to exerting tension on the cable to ensure that it is being snuggly engaged with the winch drum or other cable already wound on the winch drum, the guide 10 also enables cable 14 to be guided onto the winch drum. This guiding allows the coiled convolutions of cable wound on the drum to be closely adjacent or in contact with each other thereby providing an effective guided movement of the cable onto the drum as the drum is rotated to take up any slack in the cable during rewind. As such, the cable convolutions are snuggly wound around the winch drum and also oriented in adjacent or contacting side-by-side relation in order to enable effective subsequent unwinding of the cable from the winch drum.

To retain the half tubes 28 and 30 and the gripping members 48 assembled on the cable, internally threaded end caps 50 are screw threaded onto the external threads 36 on the split tubular member 26. Each of the end caps 50 includes a radial slot 52 which enables the end caps to be positioned laterally on the cable 14 after the gripping members 38 and the half tubes 28 and 30 have been assembled thereon with the screw threaded end caps 50 being threaded tightly onto the split tubular member 26 to an assembled position as illustrated in FIGS. 3-5.

In use, the guide 10 is assembled onto the cable 14 by assembling each of the half tubes 28 and 30 with a gripping member 38 by inserting the actuating member 44 into a slot 34. The assembled half tubes 28 and 30 with the gripping members 38 therein are then positioned on opposite sides of the cable 14 with the cable 14 being positioned in the facing grooves 42. While holding this assembly in one end, an end cap 50 is positioned over the cable by movement of the slot 52 laterally onto the cable 14 and then screw threaded onto the threads 36 on the assembled split tubular member 26. The other end cap is likewise assembled thus securing all of the components of the guide on the cable 14. Once assembled, the user may grip the guide in one hand as illustrated in FIG. 1 and exert inward pressure on the actuating members 44 to frictionally engage the grooves 42 on the plates 40 with opposite surfaces of the cable 14 as illustrated in FIGS. 4 and 5. This frictional engagement enables tension to be exerted on the cable between the guide and the winch drum 16 when the cable is being rewound. By frictionally engaging the cable 14 the approach angle of the cable to the winch drum 16 can be varied so that the convolutions of cable wound on the drum are closely and spirally related. Also, the guide can be engaged with the cable when it is desired to unwind the cable from the drum in the event it is desired to connect the hook or other connector to an object remote from the vehicle. The shape and size of the guide enables more force to be exerted on the cable than can be exerted by gripping the hook connector or the similar connectors or by gripping the cable 14 with a gloved hand.

The winch cable guide of this invention can be constructed of readily available components. The split tubular member 26 may be constructed of a tube that is metal or plastic (e.g., a plastic such as PVC), that is threaded on each end and then cut into two identical halves with the slot being formed therein either before or after the tube is cut into two identical halves. The gripping members 38 preferably are constructed of metal such as steel, aluminum or other suitable substantially rigid material with a groove formed therein being either semi-cylindrical or V-shaped. The actuating members 44 are integral with the plates 40 and therefore are constructed of the same material as the gripping members 38. The end caps 50 are conventional pipe or tube end caps having a slot 52 formed therein which extends to an inner end that is in alignment with grooves 42 in the plates 40 to enable passage of the cable 14 as illustrated in FIG. 4.

The use of the winch cable guide of this invention reduces the possibility of injury occurring when the cable is gripped by hand even if work gloves are used and also provides a more secure gripping engagement with the cable to enable greater tension to be exerted on the cable when the cable is being wound onto the winch drum or when the free end of the cable is being pulled off of the winch drum.

The foregoing should be considered as illustrative only of the principles of the invention. Since numerous modifications and changes will readily occur to those skilled in the art, it is not desired to limit the invention to the exact construction and operation shown and described. Accordingly, all suitable modifications and equivalents may be resorted to, falling within the scope of the invention.

What is claimed is:

1. A winch cable guide comprising a pair of opposed semi-cylindrical half tubes having threaded external ends, an internally threaded end cap engaging each of said threaded ends of said half tubes to form a split tubular member, a cable gripping member mounted longitudinally in each half tube, each half tube including a longitudinal closed end slot therein, each cable gripping member including an actuating member extending outwardly through one of said slots to enable a user to grip the actuating members extending through said slots to move said gripping members into a gripping engagement position so as to guide and exert tension on a cable passing between said gripping members, and each end cap having a radial slot extending from an external surface thereof inwardly to a central portion thereof and extending lengthwise along the end cap to enable the end cap to be laterally moved onto the cable into alignment with and threaded onto the threaded ends of said half tubes when the gripping members and half tubes have been assembled onto the cable to retain the half tubes, the gripping members and the end caps being assembled with the actuating members of the gripping members extending through the slots.

2. The guide as claimed in claim 1, wherein each of said gripping members is configured as an elongated plate having a groove in a surface thereof that faces the cable to provide frictional contact between the cable and the gripping members.

3. The guide as claimed in claim 1, wherein each gripping member includes a metal plate with a longitudinal groove therein that engages said cable, each actuating member extending outwardly of said half tubes when the guide is assembled to enable manual inward pressure to be exerted on said actuating members for controlling frictional engagement between the gripping members and the cable.

4. In combination with a cable connected to a rotatable drum, a handheld cable guide and gripping device comprising a split tubular member configured to receive said cable therethrough, end caps retaining the split tubular member on the cable, at least one cable gripping member mounted within said split tubular member in engagement with said cable, said gripping member including a radially extending actuating member extending radially through a wall portion of said split tubular member with an outer end of said actuating member being manually moveable radially to grippingly engage the gripping member with said cable to enable a tension force to be exerted on said cable by a user gripping the split tubular member and the actuating member, and each of said end caps having a radial slot extending from an external surface thereof inwardly to a central portion thereof and extending lengthwise along the end cap to enable, when said cable gripping member and said split tubular member have been assembled onto the cable, the end cap to be laterally positioned around the cable into alignment with and affixed to an end of the split tubular member.

5. The combination as claimed in 4, wherein said split tubular member is constructed of a plastic material and said gripping member includes an elongated plate having a groove therein with said plate being constructed of a metallic material for frictional engagement with said cable.

6. A gripping device for frictionally gripping an elongated strand of material that has a small cross section and for exerting an axial force on said strand, said gripping device comprising a split tubular member having externally threaded ends that is positioned on opposite sides of said strand, a pair of strand gripping members moveably supported by said split tubular member for movement toward and away from said strand to grip said strand, each of said gripping members including an actuating member extending outwardly of said split tubular member to enable application of inward force on said gripping members to frictionally engage said strand with said gripping members, and an internally threaded end cap engaging each of the externally threaded ends of said split tubular member to secure components of said split tubular member in assembled relation to enable the gripping members to be moved inwardly so as to frictionally engage and guide said strand, each of said end caps including a radial slot extending to a central area thereof and extending lengthwise along the end cap to enable assembly of the gripping device onto a midline area of said strand.

* * * * *